US010632585B2

(12) United States Patent
Greenslet

(10) Patent No.: US 10,632,585 B2
(45) Date of Patent: Apr. 28, 2020

(54) HYBRID TOOL WITH BOTH FIXED-ABRASIVE AND LOOSE-ABRASIVE PHASES

(71) Applicant: University of Florida Research Foundation, Inc., Gainesville, FL (US)

(72) Inventor: Hitomi Greenslet, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 155 days.

(21) Appl. No.: 15/568,494

(22) PCT Filed: Apr. 22, 2016

(86) PCT No.: PCT/US2016/028803
§ 371 (c)(1),
(2) Date: Oct. 23, 2017

(87) PCT Pub. No.: WO2016/172450
PCT Pub. Date: Oct. 27, 2016

(65) Prior Publication Data

US 2018/0154492 A1 Jun. 7, 2018

Related U.S. Application Data

(60) Provisional application No. 62/151,748, filed on Apr. 23, 2015.

(51) Int. Cl.
*B24B 1/00* (2006.01)
*B24B 31/112* (2006.01)
(Continued)

(52) U.S. Cl.
CPC ..... *B24B 1/005* (2013.01); *B24B 5/40* (2013.01); *B24B 31/006* (2013.01); *B24B 31/112* (2013.01)

(58) Field of Classification Search
USPC ..... 451/36, 104, 106, 113
See application file for complete search history.

(56) References Cited

U.S. PATENT DOCUMENTS 2,735,232 A * 2/1956 Simjian ..... B24B 31/102 451/104
4,005,550 A 2/1977 Kochemidov et al.
(Continued)

FOREIGN PATENT DOCUMENTS

WO 2010063647 A1 6/2010
WO WO2010/063647 * 6/2010 ..... B24B 37/04
WO 2013130379 A1 9/2013

OTHER PUBLICATIONS

International Search Report for PCT/US2016/028803 dated Jul. 27, 2016.

(Continued)

*Primary Examiner* — Joseph J Hail
*Assistant Examiner* — Shantese L McDonald
(74) *Attorney, Agent, or Firm* — Thomas Horstemeyer, LLP

(57) ABSTRACT

Various examples are provided for hybrid tools including fixed-abrasive and loose-abrasive phases. In one example, a hybrid tool for finishing an internal surface of a workpiece includes a metallic rod and magnetic abrasive bonded to one or more defined portions of the metallic rod by an adhesive that dissolves when n contact with a lubricant used to finish the internal surface of the workpiece. In another example, a method for finishing an internal surface of a workpiece includes mounting the workpiece in a chuck of a lathe; positioning a hybrid tool inside an internal cavity of the workpiece using one or more pole-tips; providing an amount of the lubricant to the internal cavity; and rotating the workpiece with the lathe while controlling positioning of the (Continued)

Partially heat-treated metastable stainless steel rod hybrid tool inside the internal cavity using the one or more pole-types.

14 Claims, 7 Drawing Sheets

(51) Int. Cl.
*B24B 5/40* (2006.01)
*B24B 31/00* (2006.01)

(56) References Cited

U.S. PATENT DOCUMENTS 5,319,337 A 6/1994 Matsunari et al.
7,118,673 B2 * 10/2006 Parker ..... B01D 17/0202 210/323.2
7,217,173 B1 * 5/2007 Yan ..... B24B 19/022 451/104
7,291,060 B2 11/2007 Yan et al.
8,162,720 B2 * 4/2012 Tzeng ..... B24B 31/102 451/11
8,708,778 B2 * 4/2014 Greenslet ..... B24B 1/005 451/103
2008/0066387 A1 3/2008 Bonner et al.
2012/0311935 A1 12/2012 Kujat et al.
2013/0014445 A1 1/2013 Wang et al.
2013/0059506 A1 3/2013 Qian et al.
2013/0298471 A1 11/2013 Cai et al.

OTHER PUBLICATIONS

Yamaguchi, et al., "Hybrid Tool with Both Fixed-Abrasive and Loose-Abrasive Phases", CIRP Annals Manufacturing Technology, Elsevier, vol. 64, Issue 1, 2015, pp. 337-340.
Nteziyaremye et al., "Surface Finishing of Needles for High-Performance Biopsy," Procedia CIRP, vol. 14, 2014, pp. 48-53.
Ayache et al., "Preliminary Preparation Techniques," Sample Preparation Handbook for Transmission Electron Microscopy, pp. 5-106, 2010.
Kang et al., "High-speed internal finishing of capillary tubes by magnetic abrasive finishing," Procedia CIRP, vol. 1, 2012, pp. 4414-4418.
"Metastable Austenitic Stainless Steel Tool for Magnetic Abrasive Finishing," Yamaguchi et al., CIRP Annals—Manufacturing Technology, vol. 60, Issue 1,2011, pp. 339-342.
"Internal Finishing of Capillary Tubes by Magnetic Abrasive Finishing Using a Multiple Pole-tip System," Kang et al., Precision Engineering, vol. 36, Issue 3, Jul. 2012, pp. 510-516.

* cited by examiner

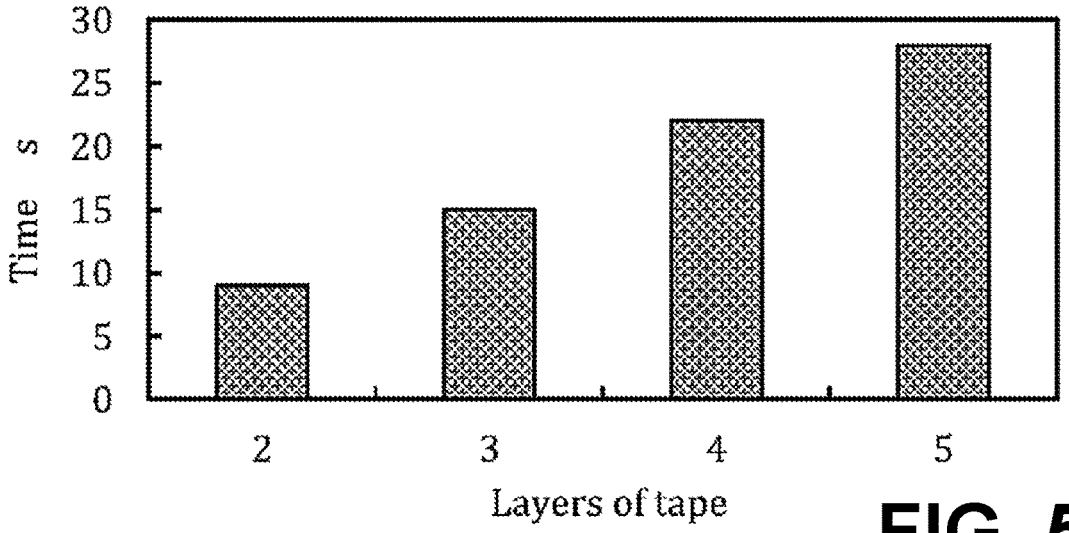

FIG. 5C

| Condition | | A | B | C | D | E |
|---|---|---|---|---|---|---|
| Mixed-type magnetic abrasive [Iron particles (150-300 μm dia.): 80 wt% Alumina magnetic abrasive (80 μm mean dia.): 20 wt%] | | 11.4 mg | | – | | |
| Hybrid tool | Rod | – | | 304 stainless steel rod (∅ 0.25×12.7 mm) | | |
| | Craft glue | | | 2.0 mg | 1.7 mg | |
| | Mixed-type magnetic abrasive | | | 7.9 mg | 7.0 mg | |
| Finishing time | | 20 s | 5 min | 20 s | 5 min | |
| Lubricant ( Water soluble-type barrel finishing compound, dilution rate 1:1) | | 90 mL | | | | 90 mL+ 90 mL (after2.5 min) |
| Workpiece | | 18 gauge 316 stainless steel tube (∅1.27×∅1.14×100 mm) | | | | |
| Workpiece revolution | | 10000 $min^{-1}$ | | | | |
| Pole tip | | 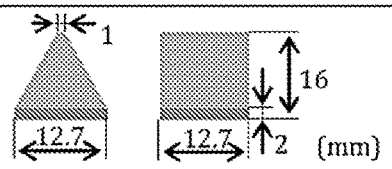  | | | | |
| Magnetic field generator | | Nd-Fe-B magnets (12.7×12.7×12.7 mm) | | | | |
| Magnetic flux density | | 0.15 T at pole tips | | | | |
| Pole-tip feed | | Feed rate: 0.6 mm/s, Length: 12.7 mm | | | | |
| Finished length | | 25.4 mm | | | | |

FIG. 6

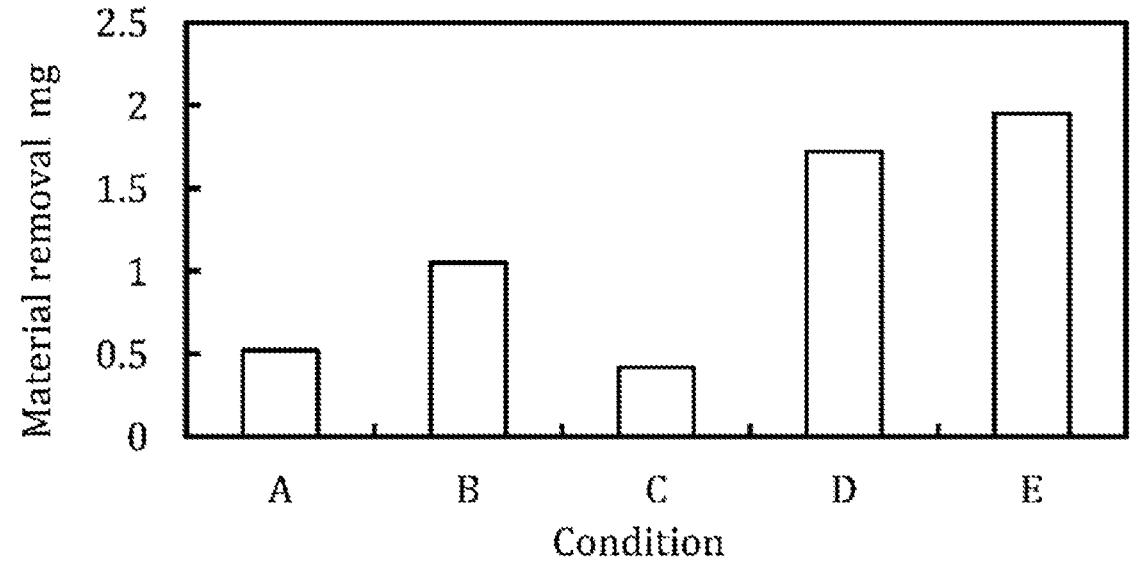
(a) Material removal
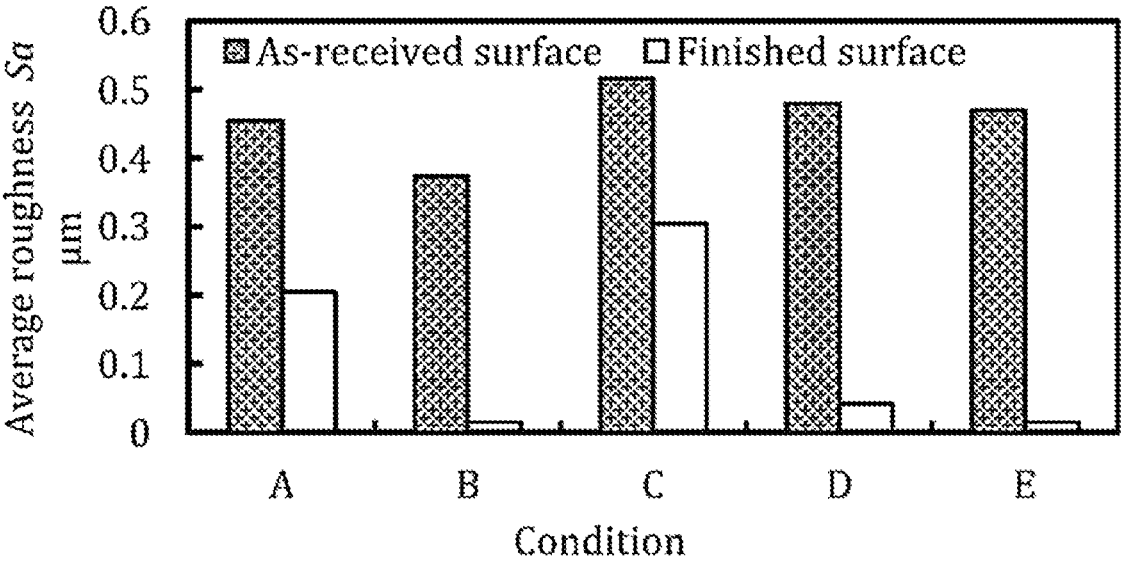
(b) Average surface roughness
Condition:
A: Magnetic abrasive for 20 s
B: Magnetic abrasive for 5 min
C: Hybrid tool for 20 s
D: Hybrid tool for 5 min
E: Hybrid tool for 5 min (lubricant added after 2.5 min)
FIG. 7

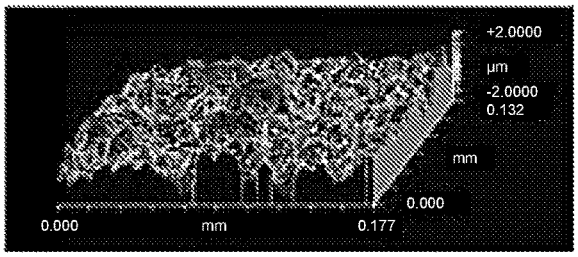
(a) As-received surface
(0.516 µm *Sa*)
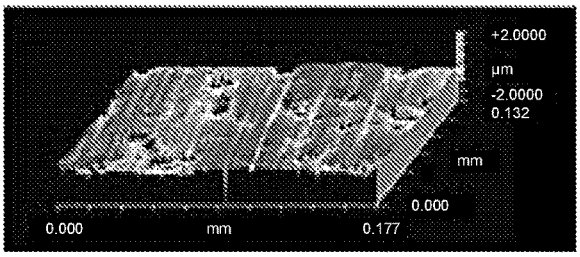
(b) Surface finished in Condition A
(0.114 µm *Sa*)
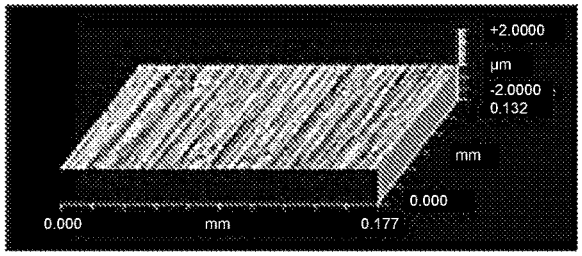
(c) Surface finished in Condition B
(0.016 µm *Sa*)
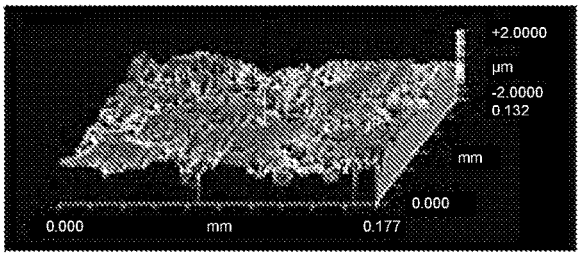
(d) Surface finished in Condition C
(0.331 µm *Sa*)
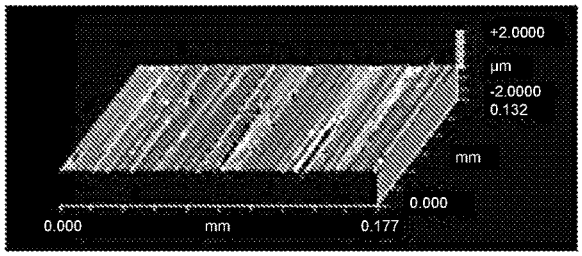
(e) Surface finished in Condition D
(0.034 µm *Sa*)
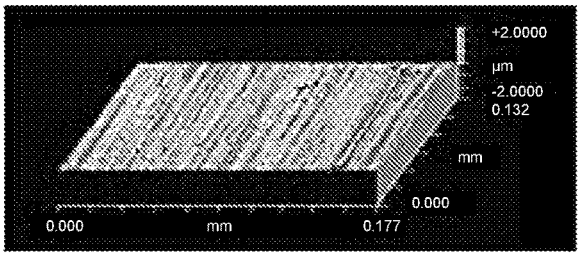
(f) Surface finished in Condition E
(0.015 µm *Sa*)
FIG. 8

HYBRID TOOL WITH BOTH FIXED-ABRASIVE AND LOOSE-ABRASIVE PHASES

CROSS REFERENCE TO RELATED APPLICATIONS

This is the 35 U.S.C. § 371 national stage application of PCT Application No. PCT/US2016/028803, filed Apr. 22, 2016, where the PCT application claims priority to, and the benefit of, U.S. provisional application entitled "HYBRID TOOL WITH BOTH FIXED-ABRASIVE AND LOOSE-ABRASIVE PHASES" having Ser. No. 62/151,748, filed Apr. 23, 2015, both of which are herein incorporated by reference in their entireties.

STATEMENT REGARDING FEDERALLY SPONSORED RESEARCH OR DEVELOPMENT

This invention was made with government support under agreement CMMI-1266179 awarded by the National Science Foundation. The Government has certain rights in the invention.

BACKGROUND

Needle biopsy procedures are used to extract tissue samples for diagnosis. Collection of bigger tissue samples allows for more accurate and more efficient diagnosis of cancers. More tissue can be collected in a biopsy procedure by increasing the needle size, collecting multiple samples, or a combination of both. The combination of lower needle insertion force, less needle deflection, and reduced friction between the tissue and needle surface can lead to a more effective biopsy procedure.

SUMMARY

Embodiments of the present disclosure are related to hybrid tools including fixed-abrasive and loose-abrasive phases, and their use. For example, hybrid tools can be used for finishing an internal surface of a workpiece.

In one embodiment, among others, a hybrid tool comprises a metallic rod and magnetic abrasive bonded to one or more defined portions of the metallic rod by an adhesive that dissolves when in contact with a lubricant used to finish an internal surface of the workpiece. In one or more aspects of these embodiments, the magnetic abrasive can transition between a fixed-abrasive phase to a loose-abrasive phase based upon an amount of the adhesive that bonds the magnetic abrasive to the metallic rod. The magnetic abrasive can comprise magnetic particles and magnetic abrasive grains. The magnetic abrasive can comprise iron and the abrasive grains comprise alumina. A diameter of the magnetic particles can be in a range from about 150 μm to about 700 μm. The abrasive particles can have a mean diameter of about 10 μm or less. The adhesive can be a water-soluble polyvinyl acetate based glue. The adhesive can be a wax. The lubricant can be water, a water-soluble liquid, or a non-water-soluble liquid. The workpiece can be a needle. The magnetic abrasive bonded to a plurality of defined portions of the metallic rod can be separated by one or more heat treated portions of the rod.

In another embodiment, a method comprises mounting a workpiece in a chuck of a lathe; positioning a hybrid tool inside an internal cavity of the workpiece using one or more pole-tips; providing an amount of a lubricant to the internal cavity; and rotating the workpiece with the lathe while controlling positioning of the hybrid tool inside the internal cavity using the one or more pole-types. The hybrid tool can comprise magnetic abrasive bonded to one or more defined portions of a metallic rod by an adhesive that dissolves when in contact with the lubricant used to finish a surface of the internal cavity. In one or more aspects of these embodiments, the hybrid tool can transition between a fixed-abrasive phase to a loose-abrasive phase based upon an amount of the adhesive that bonds the magnetic abrasive to the metallic rod. An additional amount of the lubricant can be provided to the internal cavity after a predefined period of time. The hybrid tool can transition between or from the fixed-abrasive phase to the loose-abrasive phase after the predefined period of time.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 5C is a bar graph illustrating an example of the relationship between the magnetic abrasive and adhesive layer thickness to the time for adhesive dissolution in accordance with various embodiments of the present disclosure.

FIG. 6 is a table of experimental conditions for testing hybrid tools in accordance with various embodiments of the present disclosure.

FIG. 7 includes bar graphs illustrating an example of the effects of the experimental conditions on the material removal and surface roughness using a hybrid tool for a single pole-tip system in accordance with various embodiments of the present disclosure.

FIG. 8 includes examples of surface profiles of as-received and finished internal surfaces processed using the hybrid tool of FIG. 7 in accordance with various embodiments of the present disclosure.

DETAILED DESCRIPTION

Figure 1:
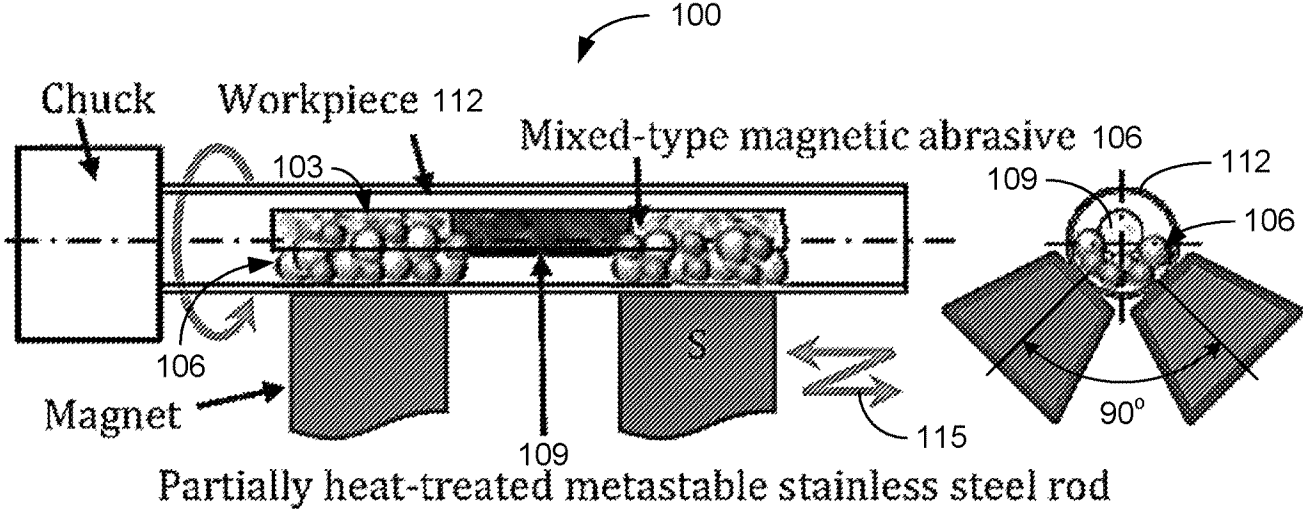
FIG. 1 is an example of a double pole-tip system in accordance with various embodiments of the present disclosure.

Disclosed herein are various embodiments of methods and systems related to hybrid tools including fixed-abrasive and loose-abrasive phases. Reference will now be made in detail to the description of the embodiments as illustrated in the drawings, wherein like reference numbers indicate like parts throughout the several views.

In addition to the edge geometries, the surface qualities of the needles have great influence on the needle-tissue interaction. Ex vivo porcine liver tissue biopsy tests that were performed using 18 gauge (1.25 mm outer diameter (OD), 0.96 mm inner diameter (ID)) 316 stainless steel Franseen-style needles have demonstrated that a smoother needle (0.03 μm Sa) can collect 55 wt % more tissue than a rougher needle (2.8 μm Sa). The smoother needle can be produced using a multiple pole-tip magnetic abrasive finishing (MAF) system. The application of MAF to needle finishing can increase the amount of tissue collected.

The use of multiple pole tips in a MAF system allows for shorter processing times, but it can also exacerbate any difficulties encountered during abrasive insertion and distribution. A hybrid tool is disclosed that initially works as a fixed abrasive but works as a loose abrasive once the abrasive binder dissolves into the lubricant. The fixed-abrasive configuration simplifies the abrasive insertion, and the loose-abrasive configuration ensures uniform distribution of the abrasive along the workpiece surface. The internal finishing of needles has demonstrated that the hybrid tool saves about 80% abrasive insertion time while achieving a smooth surface that is equivalent to the conventional MAF method.

In a multiple pole-tip MAF system, multiple areas can be finished simultaneously. This enables the high-efficiency finishing of slender tubes such as needles and catheter shafts. In the use of a multiple pole-tip system, a partially heat-treated metastable stainless steel rod with alternating magnetic and nonmagnetic sections is inserted into a tube with a mixture of iron particles and alumina magnetic abrasive (the mixture is hereafter called magnetic abrasive). FIG. 1 shows is an example of magnetic abrasive finishing (MAF) using a double pole-tip system 100. The length of the magnetic sections of the tool 103 corresponds to the pole-tip width, and both the magnetic abrasive 106 and rod 109 are magnetized and follow the lines of magnetic force inside the tube 112. Based on previous work, the tool 103 and magnetic abrasive 106 should fill 45-50% of the total space inside the tube or workpiece 112, and the magnetic abrasive 106 should be evenly distributed over the finishing area for uniform processing. However, insertion and precise distribution of such a small quantity of magnetic abrasive 106 in the limited space is tedious and accounts the largest portion of preparation time.

Coating a rod 109 with fixed abrasive is one potential method to resolve this problem. However, the needles are not perfectly straight and circular, which makes it difficult to apply fixed abrasive tools for needle finishing. Semi-solid gel abrasive (a mixture of silicone gel, ferrous particles, and abrasive) can be used to keep the abrasive at the finishing area during the finishing process. The gel abrasive can be wrapped around the rod and softens during the process due to friction heat, which facilitates lubrication and abrasive self-displacement. However, fabricating such tools and controlling the heat-dependent properties of the gel inside the needles might prove to be challenging in practice.

As an alternative, a simple abrasive tool is disclosed in which the magnetic abrasive 106 is bonded to a rod 109 by a lubricant soluble adhesive or glue and/or a wax. This makes it easy to insert the tool 103 into the needle or other workpiece 112. The tool 103 initially acts as a fixed-abrasive tool. However, the glue gradually dissolves into the lubricant and releases the magnetic abrasive 106 from the rod 109. Similarly, the magnetic abrasive 106 is released from the rod 109 when the wax is softened (or is liquefied) by heat generated from friction between the hybrid tool and workpiece surface. In the case of wax-based hybrid tool, the lubricant can be water-soluble or non-water-soluble. Examples of waxes that can be used include, but are not limited to, paraffin, vegetable or animal waxes. Eventually, all the magnetic abrasive 106 is released from the rod 109 and acts as loose abrasive, smoothing the inner surface of the needle 112 while conforming to the tube wall.

Initially, the configuration of the developed hybrid tool having fixed- and loose-abrasive phases (hereafter called a hybrid tool) is described. While the magnetic abrasive 106 is presented as a mixture of iron particles and alumina particles, other combinations of magnetic particles and/or abrasive grains may also be utilized. For example, the following cases can be considered in addition to the current magnetic abrasive mixture: (1) magnetic abrasive grains only, (2) magnetic particles only, (3) mixture of magnetic particles and conventional abrasive grains. In the case of (2), the abrasive grains, or abrasive slurry, can be added with the lubricant while finishing. Abrasives can include, but are not limited to, aluminum oxide, silicon carbides, diamond, cerium oxide, or combinations thereof. The mean diameter of the magnetic abrasive grains can be 80 μm or less. For example, the mean diameter of the actual abrasive grains in magnetic abrasive 106 is reported to be smaller than 10 μm.

In addition, even though the adhesive is presented as craft glue and a mixture of iron particles and alumina particles, other combinations of adhesives, other glues and/or adhesives can be used to hold the magnetic abrasive 106 to the rod 109. Although the waxes are not water-soluble, the heat generated by friction between the hybrid tool and workpiece surface softens the wax and allows the abrasive to disperse. Accordingly, a key factor of the hybrid tool is that the binder must be either soluble in water or lubricant or that it can be altered (e.g., softened or liquefied) by heat.

Next, the finishing characteristics using the hybrid tool are discussed using the internal finishing of 18 gauge (1.27 mm OD, 1.14 mm ID) 316 stainless steel tubes 112, which are generally used for cancer biopsy. The fixed-abrasive configuration simplifies the abrasive insertion into slender tubes and can be used to facilitate the internal finishing of tubes that are more than 1 m long. In general, a precision component undergoes three machining processes during fabrication: cutting, grinding, followed by polishing processes. It means that three machine tools are used to produce the finished component. The hybrid tool can perform both grinding and polishing without having to un-chuck and re-chuck the workpiece, which can reduce or eliminate potential positioning errors resulting from the transition between machine tools. This may also to lead to significant reductions in the production time and cost.

Finally, the finishing mechanism of the hybrid tool is clarified and compared to a conventional MAF method using unbonded magnetic abrasive. In the case of the internal finishing of needles, the finishing experiments demonstrate that the hybrid tool can save about 80% of the abrasive insertion time while achieving a smooth surface that is equivalent to a conventional magnetic abrasive finishing method. While the hybrid tool is evaluated in the context of internal finishing, the applications of the hybrid tool are not limited to internal polishing but can include any grinding and/or polishing process. For example, the hybrid tool can be applied to grinding and/or polishing of external surfaces, free-form surfaces, flat surfaces, etc. If the hybrid tool is applied to other types of workpieces, the tool base can be a metallic disk, block, etc. In some embodiments, a magnetic base may not be needed if the hybrid tool is solid and suspended in a magnetic field.

Development of Hybrid Tool

Figure 2A:
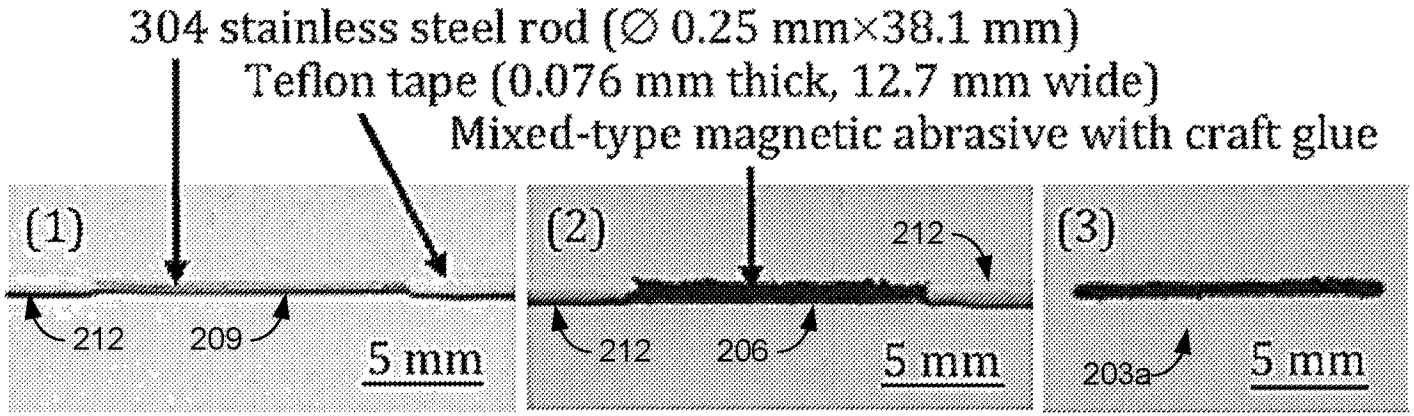
FIGS. 2A and 2B are images of examples of hybrid tools for single and double pole-tip system in accordance with various embodiments of the present disclosure.
Figure 2B:
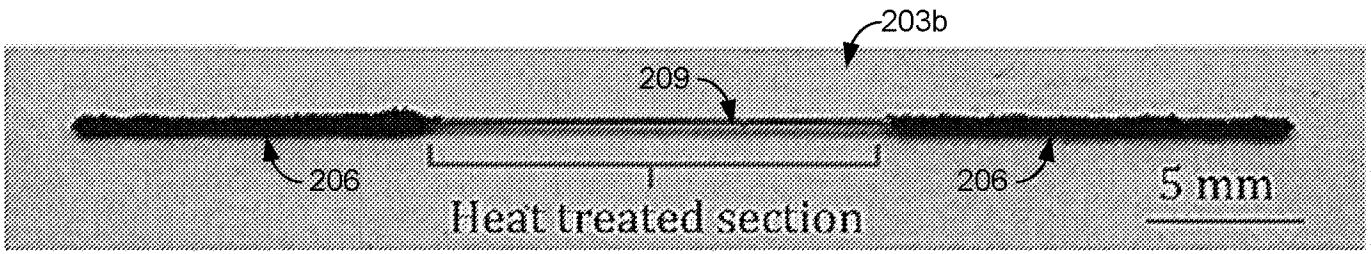

Hybrid tools 203 can be used for single or multiple pole-tip systems with releasable magnetic abrasive. FIGS. 2A and 2B show photographs of examples of hybrid tools 203. FIG. 2A includes images of a hybrid tool 203*a* for a single pole-tip system and FIG. 2B is an image of a hybrid tool 203*b* for a double pole-tip system. The hybrid tools 203 were fabricated using a combination of a 0.25 mm diameter 304 stainless steel rod 209 with magnetic abrasive 206 (150-300 μm diameter iron particles and 80 μm mean diameter alumina magnetic abrasive). The diameter of the iron particles (or other magnetic particles) may be varied depending on the target material removal rate. For example, the diameter of the magnetic particles may be in a range from about 1 μm to about 2000 μm, from about 10 μm to about 1000 μm, from about 100 μm to about 750 μm, from about 150 μm to about 700 μm, from about 150 μm to about 300 μm, or combinations thereof. As illustrated in image (1) of FIG. 2A, Teflon® tape 212 (0.076 mm thick and 12.7 mm wide) was wrapped around the rod 209 leaving a distance equal to the desired tool length between the wrapped sections. Other tapes such as, e.g., polytetrafluoroethylene tapes can also be used to control the thickness of the abrasive and adhesive for the hybrid tool fabrication.

The magnetic abrasive 206 was glued between the wrapped portions of the rod 209, so the number of layers of the tape 212 provided a measure of the thickness of the magnetic abrasive layer as shown in image (2) of FIG. 2A. The glue (adhesive) used in this implementation was water-soluble polyvinyl acetate based glue (also known as craft glue). After curing the glue at room temperature, the tape 212 was removed and the rod 209 was sectioned to the desired length to produce the hybrid tool 203*a* shown in image (3) of FIG. 2A. Hybrid tools 203 for multiple pole-tip systems can be fabricated in a similar fashion, with Teflon® tape covering the intermediate sections of the rod 209 during coating with the magnetic abrasive 206. The rod 209 can then be sectioned to the desired length to produce, e.g., the hybrid tool 203*b* for a double pole-tip system shown in FIG. 2B.

Learning the behavior of the hybrid tool 203, such as the transition from fixed abrasive to loose abrasive and the time needed for the glue to dissolve into the lubricant and release the magnetic abrasive 206 from the rod 209, can be advantageous. The hybrid tool 203 behavior in the lubricant was observed using a transparent glass tube with an OD×ID× length of ø2.78×ø2.25×90 mm. To simplify the test, a hybrid tool 203*a* with a single pole-tip system (FIG. 2A) was applied using water as the lubricant. The hybrid tool 203*a* was made of 17.03 mg of magnetic abrasive 206 and 7.44 mg of glue around a 0.25 mm diameter rod 209, resulting in a hybrid tool 203*a* that is approximately 1 mm in overall diameter.

Figure 3A:
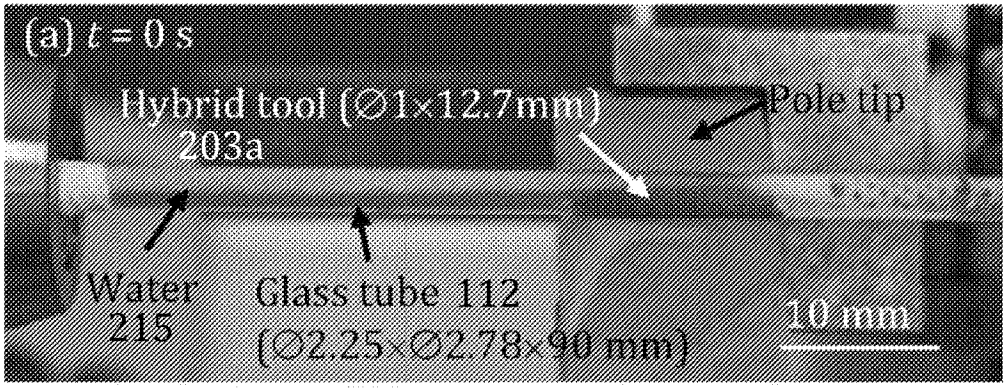
FIGS. 3A and 3B are images of an example of a hybrid tool finishing an internal surface of a glass tube in accordance with various embodiments of the present disclosure.
Figure 3B:
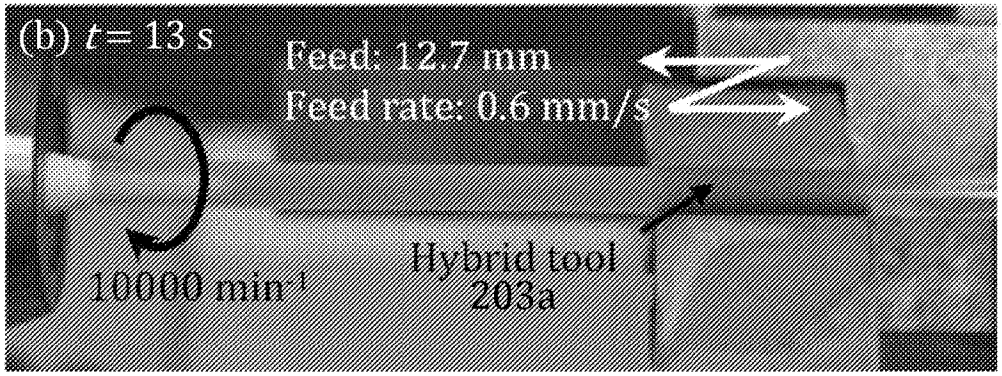

FIGS. 3A and 3B show images of the hybrid tool 203*a* in water 215 (lubricant) at t=0 s and t=13 s, respectively. When the tube (workpiece) 112 was rotated at 10,000 r/min, the hybrid tool 203*a* showed smooth relative motion against the inner tube surface. Iron oxidation caused the water 215 to immediately turn brown. The glue gradually dissolved into the water 215, and the magnetic abrasive 206 completely detached from the rod 209 after 13 s. Once the magnetic abrasive 206 became loose, it stayed between the inner tube surface and the rod 209 and maintained smooth relative motion against the inner surface of the tube 112. This demonstrated the feasibility of the hybrid tool 203 to perform fixed-abrasive finishing followed by loose-abrasive finishing.

Figure 4:
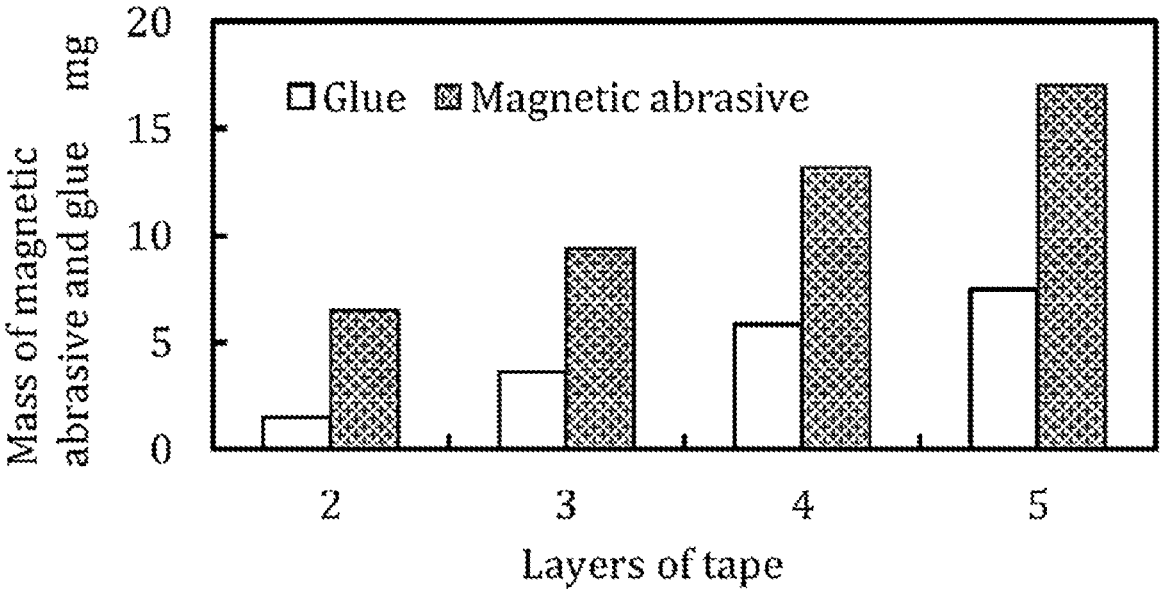
FIG. 4 is a bar graph illustrating an example of the relationship between the mass of magnetic abrasive and adhesive to the number of layers of tape used to fabricate a hybrid tool in accordance with various embodiments of the present disclosure.

The transition from a fixed-abrasive phase to a loose-abrasive phase depends on the type and/or amount of glue, which also influence the thickness of the mixture of magnetic abrasive 206 and adhesive. Therefore, the effects of the thickness of the mixture on the time needed to dissolve the glue and release the magnetic abrasive 206 were examined using an accelerated testing setup. Hybrid tools 203 with four different thicknesses of the magnetic abrasive 206 glued to 0.25 mm diameter rods 209. The thickness was controlled by the number of layers of Teflon® tape 212 (FIG. 2A) secured around the rod 209; with two, three, four, and five layers of tape 212 corresponding to 0.54 mm, 0.7 mm, 0.85 mm, and 1 mm outer diameters, respectively, for the magnetic abrasive 206 coating on the hybrid tools 203. As shown in FIG. 4, the amount of magnetic abrasive 206 and glue was increased linearly with the number of layers of Teflon® tape 212. Each hybrid tool 203 was placed in water 215 and sonicated using ultrasound. The time needed to dissolve the glue to release the magnetic abrasive mixture from the rod 209 was measured.

Figure 5A:
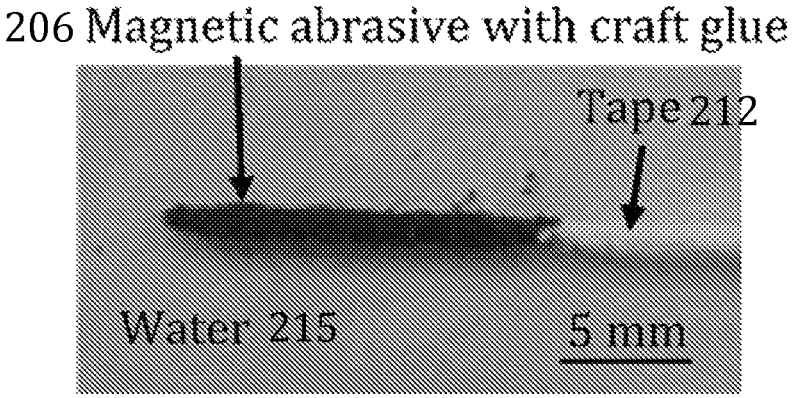
FIGS. 5A and 5B are images illustrating the release of magnetic abrasive from the hybrid tool in accordance with various embodiments of the present disclosure.
Figure 5B:
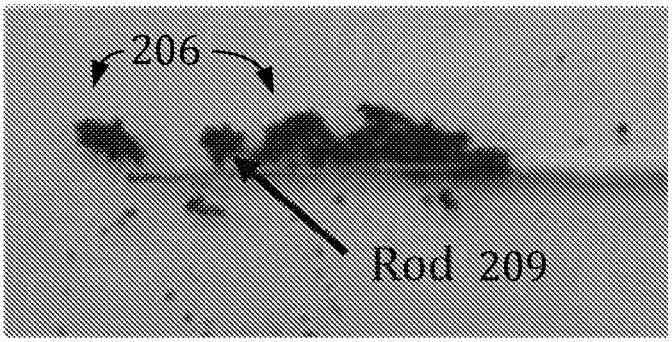

FIGS. 5A and 5B are images illustrating the release of the magnetic abrasive 206 from the rod 206 before sonication and after sonicating for 10 s, respectively. FIG. 5C shows the relationship between the time needed to release the magnetic abrasive 206 and the number of layers of the tape 212 (i.e., the outer diameter of the abrasive mixture on the hybrid tool 203). The larger the hybrid tool outer diameter with more glue, the longer the time needed to release the magnetic abrasive 206. As can be seen in FIG. 5C, the increase was approximately linear. This suggested that the time needed for transition from the fixed-abrasive phase to the loose-abrasive phase can be controlled by the amount of glue or adhesive.

Fundamental Performance of Hybrid Tool

Finishing experiments were conducted with a thin-wall 18 gauge tube 112 (01.27×01.14×100 mm) using a hybrid tool 203*a* with a single pole-tip system. The finishing system included a pair of pole tips, each with three neodymium magnets (12.7×12.7×12.7 mm), installed 90° apart from each other to generate the desired magnetic field at the finishing area as illustrated in FIG. 1. The default finished length corresponds to the pole tip width in the axial direction (12.7 mm). The translation (e.g., 115 of FIG. 1) of the pole-tips along the tube 112 axis extends the finished area. The length of the finished section was 25.4 mm, which corresponds to the sum of the pole-tip length and the stroke distance.

Referring to FIG. 6, shown is a table listing five experimental conditions to examine the performance of the hybrid tool 203*a*. Conditions A and B use unbonded magnetic abrasive and conditions C, D, and E use hybrid tools. Conditions A and B were applied to compare the material removal mechanism between the hybrid tool 203*a* and unbonded magnetic abrasive. Condition C (hybrid tool finishing time for 20 s) was used to reveal the material removal mechanisms while the hybrid tool 203*a* acted in the fixed-abrasive phase. Condition D (hybrid tool finishing time for 5 min) experienced the fixed-abrasive phase followed by the loose-abrasive phase. Under condition E, the hybrid tool 203*a* was supplied with additional of the lubricant during the finishing process.

Initially, the material removal was measured as the change in weight before and after finishing measured with a microbalance (0.01 mg resolution). Then, the tube 112 was mounted in epoxy putty and sectioned in order to measure the internal surface roughness Sa. The roughness was measured using an optical profiler every 5 mm in the axial direction starting at a point 35 mm from the free end. Experiments were repeated three times under each condition.

Referring to FIG. 7, shown are the effects of the experimental conditions on the material removal and surface roughness. Table (a) shows the material removal and table (b) shows the initial and finished surface roughness for each of the five conditions. The results shown in the bar graphs are averages of the data from three experiments carried out under the same conditions. FIG. 8 shows representative surface profiles obtained by an optical profiler. Image (a) of FIG. 8 shows an example of the as-received surface. The magnetic abrasive in condition A removed material from the surface peaks along the tube surface for 20 s, as illustrated in image (b) of FIG. 8. However, the finishing time (20 s) was too short to completely remove the unevenness and left some valleys in places from the as-received surface. Extending the finishing time to 5 min in condition B doubled the material removal, and the final surface was a uniform, MAF-processed smooth surface, as illustrated in image (c) of FIG. 8.

In contrast, the hybrid tool 203*a* in condition C acted as a fixed-abrasive tool. Because neither the tube 112 nor the hybrid tool 203*a* was perfectly straight and circular, the hybrid tool 203*a* could only have limited contact with the uneven tube surface during processing, leading to lower material removal, as illustrated in image (d) of FIG. 8, compared to that produced in condition A (image (b) of FIG. 8). Extending the finishing time under condition D (hybrid tool finishing time for 5 min) gave time for the glue to dissolve into the lubricant and release the magnetic abrasive 206 from the rod 209. However, the glue did not completely dissolve, and some soft lumps of bonded magnetic abrasive 206 were observed after finishing. The magnetic abrasive 206, including these lumps, was sandwiched between the inner surface of the tube 112 and rod 209, and participated in the surface finishing. As a result, the material removal in condition D more than tripled from that in condition A, but the lumps caused some deep scratches on the tube surface, as illustrated in image (e) of FIG. 8. These results suggest that 90 mL of lubricant was not enough to completely dissolve the glue and separate the magnetic abrasive 206.

Condition E (hybrid tool finishing for 5 min, with additional lubricant after 2.5 min) was developed to examine the effects of additional lubricant on the finishing characteristics. After finishing for 5 min in condition E, no lumps of magnetic abrasive 206 were observed. The unbonded magnetic abrasive was pressed by the rod 209 and removed material uniformly while conforming to the inner surface of the tube 112. Condition E resulted in a smoothly finished surface and an increase in the material removal over that of condition D, as illustrated in image (f) of FIG. 8. The series of experiments using the single pole-tip system demonstrated the proof of concept of the hybrid tool 203 and the importance of complete glue dissolution to separate the magnetic abrasive 206 for producing a high-quality finished surface.

Internal Finishing of 18 Gauge Tubes Using a Hybrid Tool

The main goal of the development of the hybrid tool 203 was its application in a multiple pole-tip system, which utilizes a deeper insertion of the magnetic abrasive 206 into the tube 112. The performance of the hybrid tool 203 in a double pole-tip system will next be examined for the internal finishing of a thin-wall 18 gauge tube 112 (ø.27×ø1.14×150 mm).

An example of the hybrid tool 203*b* for the double pole-tip system is shown in FIG. 2B. A 304 stainless steel rod 209 (ø0.25×ø38.1 mm) was prepared with a heat-treated section corresponding to the section between the pole tips of the finishing machine. Three turns of Teflon® tape 212 was wrapped around at the heat-treated section of the rod 209, and magnetic abrasive 206 (16.03 mg) was adhered in two sections of the rod 209 with glue (3.35 mg) on either end of the heat treated section, as shown in FIG. 2B. The resulting outer diameter of the hybrid tool 203*b* was approximately 0.7 mm. After the glue was cured, the tape 212 was removed from the rod 209.

The basic conditions for the finishing experiments (conditions G and H) following the conditions D and E listed in the table of FIG. 6. The parameters that were modified for the double pole-tip system include the pole-tip feed length (12.7-16 mm) and amount of lubricant (90-100 mL). The extension of the pole-tip feed was intended to overlap the finished length (54.1 mm) by both pole-tips so as to create more uniform finishing. The increase of the lubricant accounted for the extension of the finished tool length. Finishing experiments using an existing method (condition F), using a partially heat-treated rod (ø10.25×38.1 mm) with unbonded magnetic abrasive (11.19 mg per section), were also performed to compare the finishing characteristics with those of the hybrid tool 203*b*. In conditions F and G, the lubricant was added at the start of finishing experiments. In addition to the initial lubricant, additional lubricant was added at t=2.5 min in condition H. Finishing experiments were run for 5 min in all conditions.

Figure 9:
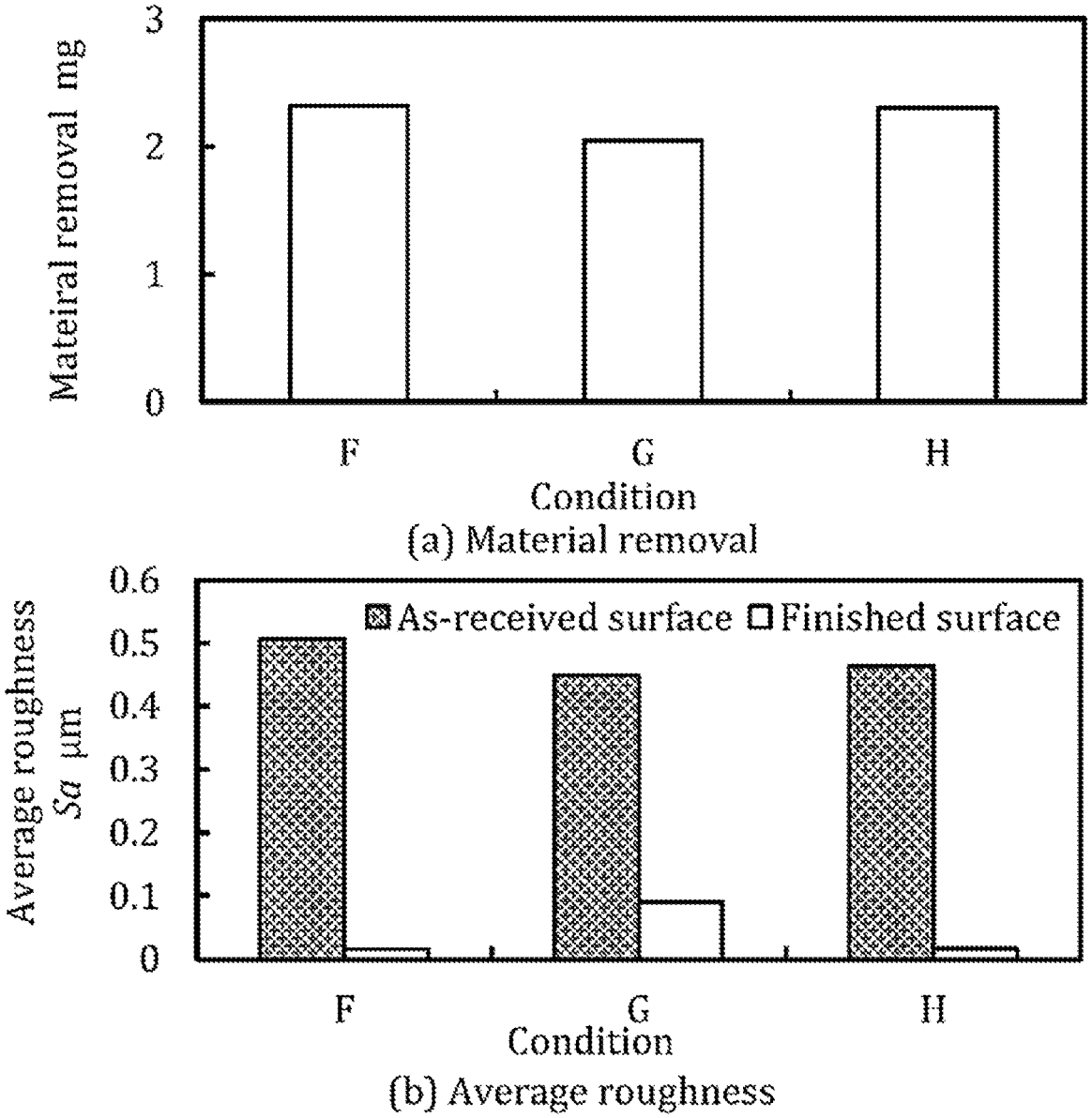
FIG. 9 includes bar graphs illustrating an example of the effects of the experimental conditions on the material removal and surface roughness using a hybrid tool for a double pole-tip system in accordance with various embodiments of the present disclosure.

Referring to FIG. 9, shown are the effects of the experimental conditions on the material removal and surface roughness using the hybrid tool 203*b* for the double pole-tip system. Table (a) shows the material removal and table (b) shows the initial and finished surface roughness for each of the three conditions. In conditions F and H, the surfaces were similarly finished and the material removal was 2.3 mg in both cases. In condition G, some lumps of bonded magnetic abrasive 206 was observed after finishing, slowing down the finishing. This demonstrated that the hybrid tool 203 is also feasible for the double pole-tip system. The time needed to insert the magnetic abrasive 206 was reduced from roughly 1 min to less than 10 s, and the tool saved nearly 40% magnetic abrasive 206 in comparison to the existing method.

CONCLUSIONS

The results of this disclosure can be summarized as follows:

A hybrid tool 203 that initially acts as a fixed-abrasive tool, but enters a loose-abrasive phase as the abrasive bonding agent dissolves is disclosed. The hybrid tool 203 can be fabricated using a lubricant soluble adhesive such as, e.g., craft glue.

The time needed to transition from the fixed-abrasive phase to the loose-abrasive phase depends on the dissolution of the adhesive and can be controlled by adjusting the amount of glue used.

Even though the hybrid tool 203 used 40% less abrasive material 206, the finishing characteristics using the hybrid tool 203 compared favorably with the existing method using unbonded magnetic abrasive.

The hybrid tool 203 drastically facilitates the tool insertion and improves the robustness of the process.

The use of an MAF system with more than two pairs of pole tips further exacerbates any difficulties encountered in abrasive insertion and distribution. The disclosed hybrid tool 203 helps overcome these difficulties and will thus aids in potential scaling of the MAF process.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A hybrid tool for finishing an internal surface of a workpiece, the hybrid tool comprising:

a metallic rod; and magnetic abrasive bonded to a plurality of defined portions of the metallic rod by an adhesive that dissolves when in contact with a lubricant used to finish the internal surface of the workpiece, where the magnetic abrasive bonded to the plurality of defined portions of the metallic rod is separated by one or more heat treated portions of the metallic rod.

2. The hybrid tool of claim 1, wherein the magnetic abrasive transitions between a fixed-abrasive phase to a loose-abrasive phase based upon an amount of the adhesive that bonds the magnetic abrasive to the metallic rod.

3. The hybrid tool of claim 1, wherein the magnetic abrasive comprises magnetic particles and magnetic abrasive grains.

4. The hybrid tool of claim 3, wherein the magnetic abrasive comprises iron and the magnetic abrasive grains comprise alumina.

5. The hybrid tool of claim 4, wherein a diameter of the magnetic particles is in a range from about 150 μm to about 700 μm.

6. The hybrid tool of claim 4, wherein the abrasive particles have a mean diameter of about 10 μm or less.

7. The hybrid tool of claim 1, wherein the adhesive is a water-soluble polyvinyl acetate based glue.

8. The hybrid tool of claim 1, wherein the adhesive is a wax.

9. The hybrid tool of claim 1, wherein the lubricant is water, a water-soluble liquid, or a non-water-soluble liquid.

10. The hybrid tool of claim 1, wherein the workpiece is a needle.

11. A method for finishing an internal surface of a workpiece, the method comprising:

mounting the workpiece in a chuck of a lathe;

positioning a hybrid tool inside an internal cavity of the workpiece using one or more pole-tips, the hybrid tool comprising magnetic abrasive bonded to one or more defined portions of a metallic rod by an adhesive that dissolves when in contact with a lubricant used to finish a surface of the internal cavity;

providing an amount of the lubricant to the internal cavity; and rotating the workpiece with the lathe while controlling positioning of the hybrid tool inside the internal cavity using the one or more pole-tips.

12. The method of claim 11, wherein the hybrid tool transitions between a fixed-abrasive phase to a loose-abrasive phase based upon an amount of the adhesive that bonds the magnetic abrasive to the metallic rod.

13. The method of claim 11, comprising providing an additional amount of the lubricant to the internal cavity after a predefined period of time.

14. The method of claim 13, wherein the hybrid tool transitions between a fixed-abrasive phase to a loose-abrasive phase after the predefined period of time.

* * * * *